United States Patent [19]

Brown

[11] Patent Number: 4,786,057

[45] Date of Patent: Nov. 22, 1988

[54] GOLF SWING TRAINING DEVICE

[76] Inventor: Larry G. Brown, 262 Victoria Dr., Greenville, Ohio 45331

[21] Appl. No.: 99,820

[22] Filed: Sep. 23, 1987

[51] Int. Cl.[4] ..... A63B 69/36

[52] U.S. Cl. ..... 273/186 R; 273/183 E; 273/183 A

[58] Field of Search ..... 273/186 R, 186 C, 183 A, 273/183 E, 186 B, 200 B, 197 R, 197 A

[56] References Cited

U.S. PATENT DOCUMENTS

| | | | |
|---|---|---|---|
| 2,712,939 | 7/1955 | Harp | 273/186 R |
| 3,312,474 | 4/1967 | Mitchell | 273/186 R |
| 3,992,011 | 11/1976 | Jessee | 273/183 A |

FOREIGN PATENT DOCUMENTS

| | | | |
|---|---|---|---|
| 383767 | 11/1932 | United Kingdom | 273/186 R |

*Primary Examiner*—George J. Marlo

*Attorney, Agent, or Firm*—Biebel, French & Nauman

[57] ABSTRACT

The invention is concerned with an apparatus for use in perfecting a golfer's backswing so that his club swings close to the ground. The apparatus includes a base to which a pivoting flap and a golf tee are mounted. The flap is positioned on a swing arm rotatably mounted with respect to the tee. The flap remains in a vertical position until struck by a golf club during a golfer's backswing whereupon the flap moves to a horizontal position to allow the golfer to continue to move the club in the proper path during his forward swing.

20 Claims, 2 Drawing Sheets

GOLF SWING TRAINING DEVICE

BACKGROUND OF THE INVENTION

The present invention relates to a golf training apparatus and, in particular, to a golf training apparatus designed to perfect a golfer's backswing.

It is a common practice among golfers to use training devices in order to perfect their stance and/or swing. Some of these devices are part of equipment available for use at driving ranges or on the golf course, and some are portable units which are owned by golfers and are used in small areas such as a home or an office.

In order for a golfer to have a proper swing, he must control his club so that as it swings, the club head moves along a proper path. The presently available devices typically seek to enhance this control through means which improve a golfer's stance or through means which indicate to a golfer that he has swung his club out of a desired plane. Examples of such devices are shown in U.S. Pat. Nos. 1,427,538, 3,753,563 and 3,554,555. None of the presently available devices, however, provide for correcting the overall swing of a golfer by concentrating in particular on control of his backswing.

It is the opinion of many golfers that proper control of the backswing, that is, keeping the backswing in the proper path, with the club kept close to the ground, will contribute much toward control of the forward swing. Thus, it would be advantageous for golfers to concentrate attention on perfecting their backswing in addition to their stance or their forward swing.

What is needed, therefore, is a simple and inexpensive device which will help a golfer improve his overall swing by concentrating on the backswing rather than on the stance or the forward swing.

SUMMARY OF THE INVENTION

The present invention discloses a golf training device including a base upon which a golf tee and a flap are mounted. A stop supports the flap in a vertical position. The flap is supported on the base in a position with respect to the tee so that the flap can be struck by a golf club during a golfer's backswing. Additionally, the flap is supported so that it moves from a vertical position to a horizontal position when struck by a golfer's club.

Preferably, the flap is supported on the base by positioning it in a slide constructed to fit in one of several slots which are part of the base. The slide has two vertical members and one horizontal member with a stop attached to the horizontal member. Holding pins are inserted through the vertical members to position the flap in a pivoting position so that it goes from a vertical position to a horizontal position when struck by a golf club.

Before the golfer starts his backswing, the flap is supported in a vertical position by the stop. If the swing is in the proper path, with the club head kept close to the ground, the club will hit the flap, moving the flap to a horizontal position, thus freeing the area for the club to move in the proper path during the forward swing.

Preferably, the base will have a platform area on which a rotating swing arm is mounted. In this embodiment, the slots in which the slide is positioned are on the rotating swing arm. The swing arm is mounted to the platform in a manner which allows the swing arm to be secured in several different positions according to the desire of the golfer. The swing arm is secured by means of holes drilled in both ends of the platform with holding pins attached to the swing arm so that the pins may be positioned in the holes.

The golf tee may contain a lighting display means which is powered by a battery attached to the base and which is activated by a switch which is also mounted on the base. This lighting display means provides a light which is visible to the eye of the golfer only after the golfer strikes a golf ball from the tee. This lighting display helps to focus the eye of the golfer on the ball until after it is struck from the tee.

The object of this invention is to provide for a golfer a device which will help to perfect his backswing, is simple to use and is easily transported from place to place.

Other objects and advantages of the invention will be apparent from the following description, the accompanying drawings and the appended claims.

DETAILED DESCRIPTION OF PREFERRED EMBODIMENT

Figure 3:
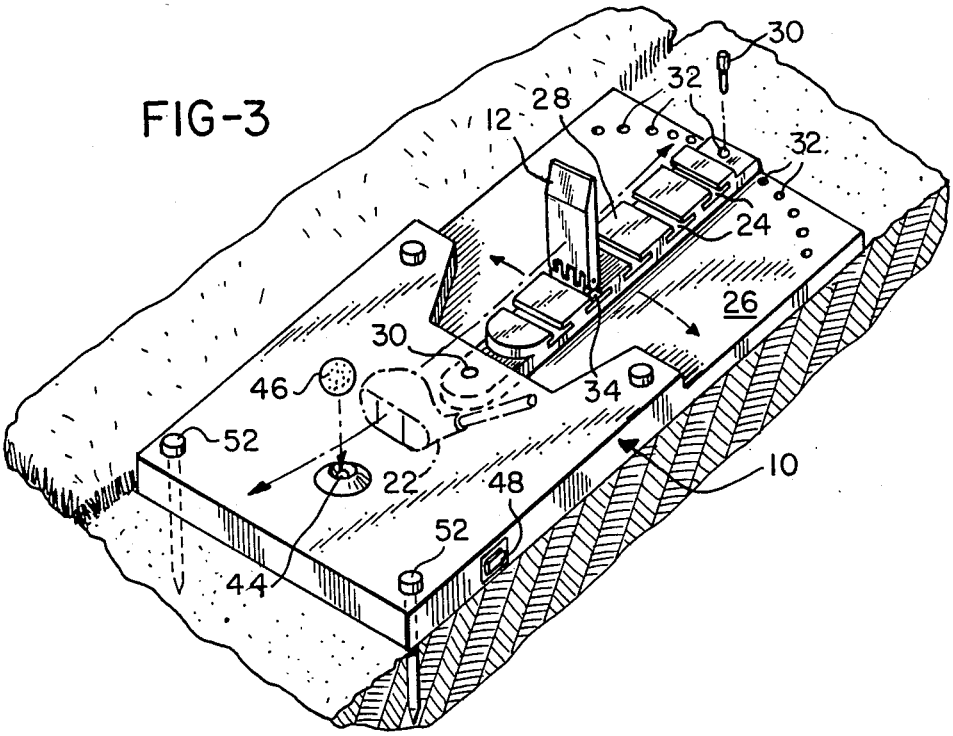
FIG. 3 is an elevational view of the apparatus showing the position of the various elements of the apparatus.
Figure 5:
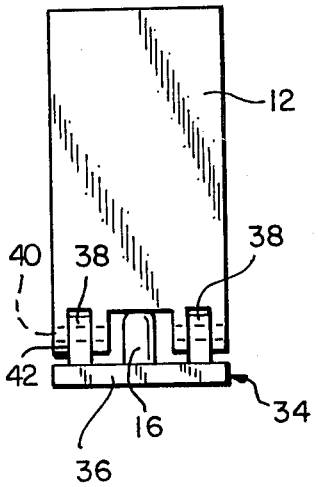
FIG. 5 is a perspective view of the flap positioned vertically in the slide.

As shown in FIG. 3, the golf training apparatus includes a base 10 upon which a flap 12 is mounted in a pivotal position and is vertically supported by a stop 16 made of a semi-rigid material such as rubber or plastic, as shown in FIG. 5. The flap is made of a rigid or semi-rigid material, preferably rubber or plastic.

Figure 2:
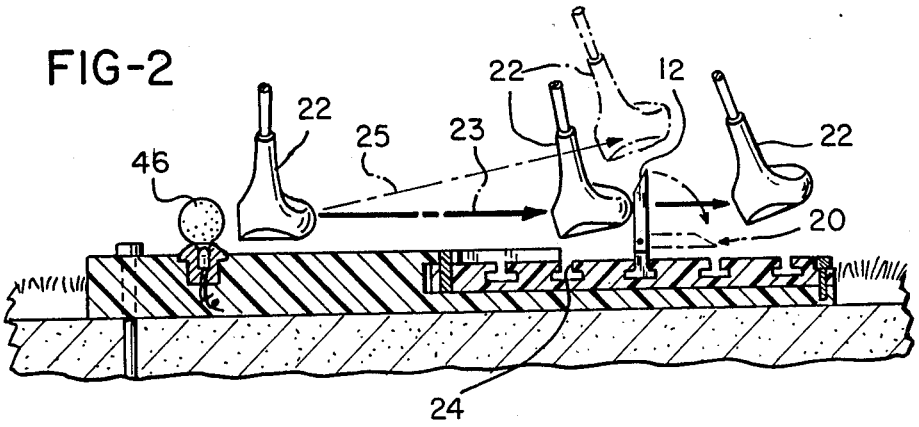
FIG. 2 is a side view of the training apparatus showing the path of the golf club during the backward swing of the golfer.
Figure 4:
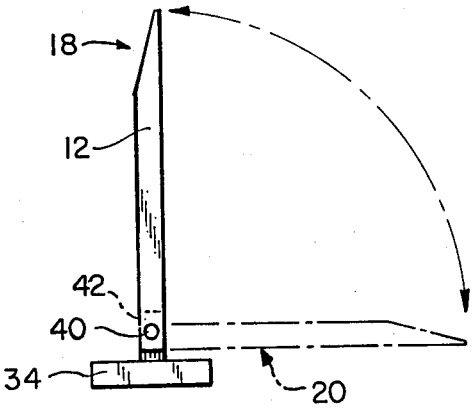
FIG. 4 is a side view showing the movement of the flap from a vertical position to a horizontal position.

As shown in FIGS. 2 and 4, the flap 12 is supported in a pivotal position so that it moves from a vertical position 18 to a horizontal position 20 when struck by a golf club 22 moving along the correct backswing path 23. The horizontal position 20 of the flap 12 allows the golf club 22 to move in the proper path, that is, close to the ground, during the subsequent forward swing of the golfer. If the flap 12 does not move to a horizontal position 20 during the backswing of a golfer, it is an indication to the golfer that his golf club 22 traversed an incorrect backswing path 25, and was not kept low enough to the ground during the backswing.

As shown in FIG. 3, several slots 24 are constructed in the base 10 of the apparatus so that the golfer using the apparatus may position the flap 12 according to the length of his swing. It may be that a short person will require a different location of the flap 12 than that required by a taller person. Additionally, the type of club used will affect the size of the swing. Thus, the flap 12 may be shifted to suit the size and convenience of the golfer and the type of club being used.

Preferably, the base 10 has a platform area 26 on which a rotating swing arm 28 is constructed. Several slots 24 are formed on the swing arm 28. The swing arm 28 is mounted on the platform 26 by means of holding pins 30 which may be inserted in several different holes 32 constructed in the platform 26. The golfer using the apparatus may position the swing arm 28 according to the preferred direction of his swing. An adjustment in the position of the swing arm can compensate for and correct a golfer's tendency to hit the ball off course, such as a hook or slice. Alternatively, the swing arm can be positioned off center to help train the golfer in deliberately hooking or slicing the ball to improve his drive. Holding pins 30 each have a clip on the bottom so the pin is not lost while changing settings.

In the preferred embodiment of this invention, the flap 12 is supported on a slide 34, which is constructed to fit into one of the slots 24 located on the rotating swing arm 28. Slide 34 is constructed of a rigid or semi-rigid material, preferably rubber or plastic.

Slide 34 includes one horizontal member 36 and two vertical members 38. The flap 12 is supported on the slide 34 by means of holding pins 40 inserted through the sides 42 of the slide 34, as shown in FIGS. 4 and 5. As also shown in FIG. 5, in the preferred embodiment a stop 16 is mounted on the horizontal member 38 of the slide 34 in order to hold the flap 12 in a vertical position 18 until it is struck by the golf club 22 during the golfer's backswing, as shown in FIG. 2. Stop 16 is constructed of a rigid or semi-rigid material, preferably rubber or plastic.

Figure 1:
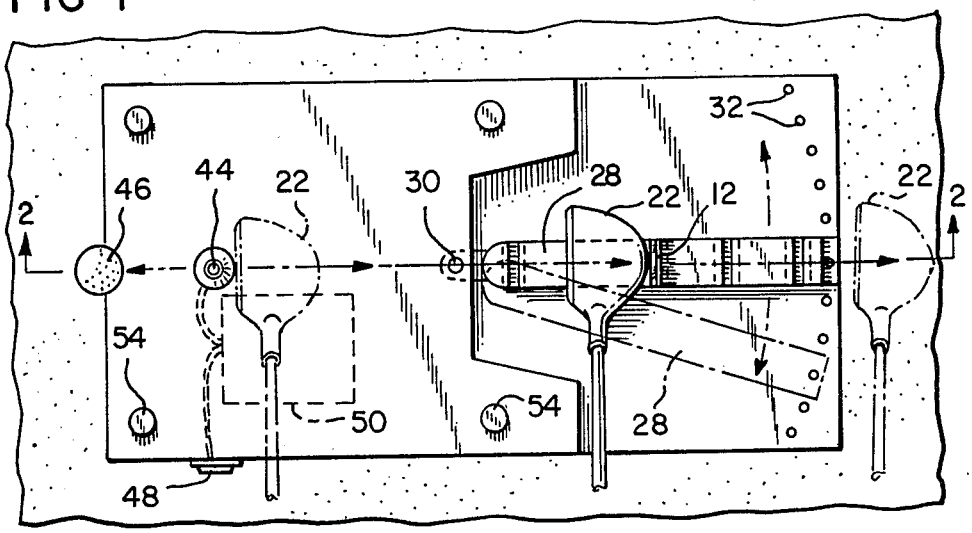
FIG. 1 is a perspective view showing the path of the golf club during the forward and backward swings of the golfer.

A lighting display 44 is positioned in the ball-receiving cup of the golf tee 14 and is visible to the golfer only after the golf ball 46 is struck from the golf tee 14, as shown in FIG. 1. Upon viewing the lighting display 44, the golfer knows that he has properly focused his eye on the ball 46 until after the ball 46 is struck during his forward swing. This focusing on the ball will aid in keeping the golfer from making a "top shot", that is, hitting the top, rather than the side, of the golf ball.

The lighting display 44 is activated by a switch 48 which is mounted on the base 10 as shown in FIG. 1, and which is electrically connected to the lighting display 44. Additionally, the lighting display 44 is powered by a battery enclosed in a battery case 50 mounted on the base 10, as shown in FIG. 1.

Preferably, base 10 will have a straight edge so that proper feet alignment can be made for correct positioning. Base 10 should preferably be one and one fourth inches from the ground level to ball 46, thus giving the golfer the same degree of height as he has when teeing his ball 46 off the golf course without this apparatus.

In the preferred embodiment, the golf training apparatus is used on a driving range, or golf course or other large outside area and holding pins 52 are inserted through holes 54 constructed in the base 10 of the apparatus in order to secure the apparatus to the ground, as shown in FIG. 3. The base 10 may be covered with an artificial turf-like material in order to simulate actual golf game conditions or with an alternate covering such as felt. The base 10 and platform 26 should be constructed of a hard material such as plastic or wood.

In view of the foregoing, the use of the golf training apparatus should be readily understood. When the flap 12 is in the desired position on the base 10 and the golf ball 46 is set on the tee 14, the player draws his club 22 in a backswing, moving the club in the proper path 23 with the club head low to the gound. The flap 12 is struck and moved from a vertical position 18 to a horizontal position 20 during the backswing motion. The club 22 may then be moved in a forward swing through the area which previously contained the flap 12, thus keeping the club 22 in the proper path before striking the ball 46 from the tee 14.

By properly focusing his eye on the ball 46, the golfer will see the lighting display 44 after the ball is struck. If, during his swing, the flap 12 is moved to a horizontal position 20 and the lighting display 44 is visible, the golfer knows that his club 22 has been swung in the proper path, that is, close to the ground, during his backswing, and that he has correctly focused his eye on the ball during his swing.

By use of this golf training apparatus it is possible to make multiple practice swings and therefore form a proper backswing habit. The apparatus can be used with either woods or irons and is inexpensive and simple to use. It is also adapted for use by left-handed or right-handed golfers.

This training apparatus can be used with golf balls on a practice range or golf course, but can also be used in a yard, home or office. Preferably, the device is used with golf balls on a driving range or other large outdoor area so that the golfer can ascertain the direction and distance attained by hitting an actual golf ball, thus determining how and if his backswing has improved. However, it is also possible to use the invention in a limited area such as a home or office. In such a case, a practice ball can be used. An alternate use would be without a ball, thus allowing a golfer to practice his backward swing without the need of a large area for the driving of a golf ball.

While the form of apparatus described above constitutes the preferred embodiment of this invention, it is understood that the invention is not limited to this precise form of apparatus and changes may be made therein without departing from the scope of the invention which is defined in the appended claims.

What is claimed is:

1. A golf training apparatus comprising:

(a) a base;

(b) a golf tee mounted on said base;

(c) a flap;

(d) means for pivotably supporting said flap on said base so that said flap moves from a vertical to a horizontal position when struck by a golf club, said flap supporting means being positioned on said base with respect to said tee so that said flap is struck by the golf club during a backswing of the club;

(e) a stop adapted to support said flap in a vertical position until said flap is struck by the golf club.

2. A golf training apparatus as claimed in claim 1 further comprising a plurality of said flap supporting means so that said flap may be supported on said base in a plurality of positions.

3. A golf training apparatus as claimed in claim 2 wherein said flap supporting means includes a plurality of slits in said base.

4. A golf training apparatus as claimed in claim 3 wherein said flap supporting means further includes a slide having one horizontal member and two vertical members, said slide adapted to be positioned in said slits.

5. A golf training apparatus as claimed in claim 4 wherein said flap supporting means further includes holding pins inserted through said vertical members of said slide.

6. A golf training apparatus as claimed in claim 5 wherein said stop is attached to said horizontal member of said slide.

7. A golf training apparatus as claimed in claim 6 further comprising a lighting display means attached to said tee so that light is not visible to the eye of a player when a golf ball is positioned on said tee but is visible to the eye of a player after the golf ball is struck from said tee, and means for powering said light display means.

8. A golf training apparatus as claimed in claim 7 further comprising a switching means electrically connected to said light display means, said switching means mounted on an outer edge of said base.

9. A golf training apparatus as claimed in claim 1 wherein said base is covered with an artificial turf material.

10. A golf training apparatus comprising:

(a) a base including a platform, a swing arm, and means for rotatably attaching said swing arm to said platform;

(b) a flap;

(c) a golf tee mounted on said platform;

(d) a means for pivotally supporting said flap on said swing arm so that said flap moves from a vertical to a horizontal position when struck by a golf club, said flap supporting means being positioned on said swing arm with respect to said tee so that said flap is struck by the golf club during a backswing of a club, and;

(e) a stop adapted to support said flap in a vertical position until said flap is struck by the golf club.

11. A golf training apparatus as claimed in claim 10 further comprising a plurality of said flap supporting means so that flap may be supported on said swing arm in a plurality of positions.

12. A golf training apparatus as claimed in claim 10 wherein said flap supporting means includes a plurality of slits in said swing arm.

13. A golf taining apparatus as claimed in claim 10 wherein said flap supporting means further includes a slide having one horizontal member and two vertical members, said slide adapted to be positioned in said slits.

14. A golf training apparatus as claimed in claim 13 wherein said flap supporting means further includes holding pins inserted through said vertical members of said slide.

15. A golf training apparatus as claimed in claim 14 wherein said stop is attached to said horizontal member of said slide.

16. A golf training apparatus as claimed in claim 15 further comprising means for securing said swing arm in a plurality of positions with respect to said tee.

17. A golf training apparatus as claimed in claim 16 wherein said securing means includes a plurality of holes in an end of said platform, and holding pins attached to said swing arm and adapted to be positioned in said holes.

18. A golf training apparatus as claimed in claim 17 further comprising a lighting display means attached to said tee so that light is not visible to the eye of a player when a golf ball is positioned on said tee but is visible to the eye of a player after the golf ball is struck from said tee, and means for powering said lighting display means.

19. A golf training apparatus as claimed in claim 18 further comprising a switching means electrically connected to said light display means, said switching means mounted on an outer edge of said platform.

20. A golf training apparatus as claimed in claim 1 wherein said platform is covered with an artificial turf material.

* * * * *

UNITED STATES PATENT AND TRADEMARK OFFICE

CERTIFICATE OF CORRECTION

PATENT NO. : 4,786,057

DATED : November 22, 1988

INVENTOR(S) : Larry G. Brown

It is certified that error appears in the above-identified patent and that said Letters Patent is hereby corrected as shown below:

Column 6, line 30, "in claim 1" should be -- in claim 10 --

Signed and Sealed this

Thirtieth Day of May, 1989

*Attest:*

*Attesting Officer*

DONALD J. QUIGG

*Commissioner of Patents and Trademarks*